United States Patent [19]

Roberts, Jr. et al.

[11] 4,121,535

[45] Oct. 24, 1978

[54] HOT MELT PUMPING APPARATUS

[75] Inventors: Arthur W. Roberts, Jr., Colonial Heights; George Kesler, Richmond, both of Va.

[73] Assignee: Inta-Rota, Incorporated, Richmond, Va.

[21] Appl. No.: 778,330

[22] Filed: Mar. 16, 1977

[51] Int. Cl.[2] ..... B05C 5/02; B05C 11/10

[52] U.S. Cl. ..... 118/5; 118/7; 118/410; 118/610

[58] Field of Search ..... 118/410, 411, 401, 610, 118/7, 6, 50, 5; 55/208

[56] References Cited

U.S. PATENT DOCUMENTS

| | | | |
|---|---|---|---|
| 1,929,877 | 10/1933 | Bonamico | 118/410 X |
| 2,357,476 | 9/1944 | Kaulen | 118/410 X |
| 3,282,469 | 11/1966 | Skonberg | 222/146 HE |
| 3,522,836 | 8/1970 | King | 118/401 X |
| 3,793,805 | 2/1974 | Hoffman | 55/208 X |
| 3,938,924 | 2/1976 | Abella et al. | 425/147 |
| 4,050,411 | 9/1977 | Kimmich | 118/610 X |

*Primary Examiner*—John P. McIntosh
*Attorney, Agent, or Firm*—Cushman, Darby & Cushman

[57] ABSTRACT

A method and apparatus for the handling of hot melt materials and the like for coating a web with the hot melt. Hot melt is fed from a source through a filter to a heated tank, and from the heated tank it is pumped to an extrusion head. Pumping of the hot melt from the tank to the extrusion head is accomplished solely by providing pressurized gas at slightly more than one atmosphere pressure over the hot melt in the tank. The source pressure of the hot melt is isolated from the supply pressure at the extrusion head, and the web to be coated is passed in operative relationship with the extrusion head. The hot melt is metered in a thin film flowing over heated surfaces in order to insure thermal uniformity without agitation. The level of hot melt in the tank is maintained at a predetermined level, and the extrusion head is provided at substantially the same predetermined level so that the extrusion will not overflow or drain when the pressurized gas from the tank is vented. The hot melt is fed into the tank and withdrawn from the tank in such a way that bubbles in the hot melt come to the surface and pop and/or form a foam on the top of the hot melt so that the withdrawn hot melt is substantially air free.

14 Claims, 2 Drawing Figures

HOT MELT PUMPING APPARATUS

BACKGROUND AND SUMMARY OF THE INVENTION

The invention particularly relates to the handling of hot melts and other materials that are normally in solid form at room temperature and must be heated in order to obtain fluid properties therefor. The invention is specifically directed to a method and apparatus for the coating of a web with a hot melt material.

There are numerous proposals in the prior art for handling hot melts and for coating webs with hot melts; exemplary prior art structures are the Park Hot Melt Coater, the Kroenert Pak 400 and Pak-Melt Coaters, and structure illustrated in U.S. Pat. No. 3,938,924. While such structures are generally useful for performing their intended functions, they normally have numerous disadvantages associated therewith. For instance, such prior art devices normally use mechanical devices to stir, agitate or otherwise mix the material to insure uniform temperature and viscosity, and this mechanical agitation results in shearing of the hot melt and destruction of the integrity thereof. Additionally, such prior art structures normally maintain a larger volume of hot melt at application temperature than is efficient, with resulting thermal degradation. The prior art also requires generally more complicated structures including positive displacement pumping means and the like, and normally mechanically pumps material through the filter to process, and uses deaerators to remove air from the material. Additionally, often times there are numerous atmospheric exposure points in the prior art apparatus which provide an opportunity for degradation of the hot melt by oxidation, or require a supply of inert gas over large volumes in order to prevent oxidation. Additionally, much material is normally wasted during start-up of such prior art structures, and thermal degradation and oxidation and waste in general exist at the point of application when the structure is idle or during start-up and shut-down.

According to the apparatus of the present invention all of the above-mentioned drawbacks inherent to one extent or the other in the prior art are eliminated. According to the present invention a simple method and apparatus are provided for the coating of a web with hot melt material or the like. The apparatus according to the present invention is much simpler than the prior art, eliminating the positive displacement pumps in the prior art, mechanical agitators, deaerators, and the like without consequent elimination of their functions. The filter pressure and the supply pressure at the extrusion head are isolated, and a very small volume (i.e., 1 gallon) of hot melt need be maintained at application temperature at one time. Additionally, the areas of atmospheric exposure are limited, and such areas are provided so that an inert blanket is not necessary, or that if an inert blanket were provided, only a minimum amount of inert gas need be required. Additionally, the hot melt that is supplied at the extrusion head has generally less thermal degradation, oxidation, and mechanical shearing destruction, and is substantially air free so that undesired bubbles are not formed on the coated product.

According to the apparatus of the present invention a web is coated with hot melt material by feeding the hot melt material from a source to a filter and to a tank, supplying hot melt from the tank to an extrusion head, passing the web to be coated in operative relationship with the extrusion head to coat the web with hot melt, isolating the source pressure from the supply pressure at the extrusion head, and pumping the hot melt from the tank to the extrusion head solely by providing pressurized gas at slightly more than one atmosphere pressure over the hot melt in the tank. The pressurized gas may be air at about 15 psi. The hot melt is fed into and withdrawn from the tank in such a manner that bubbles in the hot melt come to the surface and pop and/or form a foam on the top of the hot melt so that the withdrawn hot melt is substantially air free yet an inert gas blanket need not be provided. However, inert gas may be provided at about 15 psi as the pressurized gas in the tank. The method may further comprise the step of metering the hot melt to a thin film flowing over heated surfaces in feeding the hot melt from the source to the tank, and effecting turbulent flow from the tank to the head, and thereby insuring thermal uniformity without agitation of the hot melt. The level of hot melt in the tank is maintained at a predetermined level, and the extrusion head is maintained substantially at that predetermined level also so that the extrusion head need never be drained and start-up waste of hot melt is substantially reduced.

Apparatus according to the present invention comprises apparatus for supplying liquid material to coat a web comprising a closed system including a source of liquid material, filtering means, a tank, an extrusion head, means for supplying liquid material from the source to the filtering means, means for supplying liquid material from the filtering means to the tank for isolating the material pressure at the source from the pressure at the extrusion head, means for pumping the liquid material from the tank to the extrusion head (said pumping means consisting of means for providing gas at slightly more than one atmosphere pressure over the material in the tank), and means for transporting the pumped liquid to the extrusion head from the tank. Means are also provided for maintaining liquid material in the tank at a predetermined level, the predetermined level being maintained at the level of liquid in the extrusion head so that upon venting the pressurized gas from the tank the extrusion head will not drain or overflow. The volume of the tank may be as low as 1 gallon.

The apparatus according to the present invention further comprises apparatus for supplying liquid material for application to an article including an extrusion head, a tank operatively connected to the extrusion head, means for pumping liquid material from the tank to the extrusion head (said pumping means consisting of means for providing gas at slightly more than one atmosphere pressure over the material in the tank), and means for maintaining the liquid level in the tank at a predetermined level, the predetermined level being maintained at the level of liquid in the extrusion head so that upon venting of pressurized gas from the tank the extrusion head will not drain or overflow.

It is the primary object of the present invention to provide an improved apparatus for the application of liquid materials to a web, especially hot melts. These and other objects of the invention will become clear from an inspection of the detailed description of the invention, and from the appended claims.

DETAILED DESCRIPTION OF THE INVENTION

Figure 1:
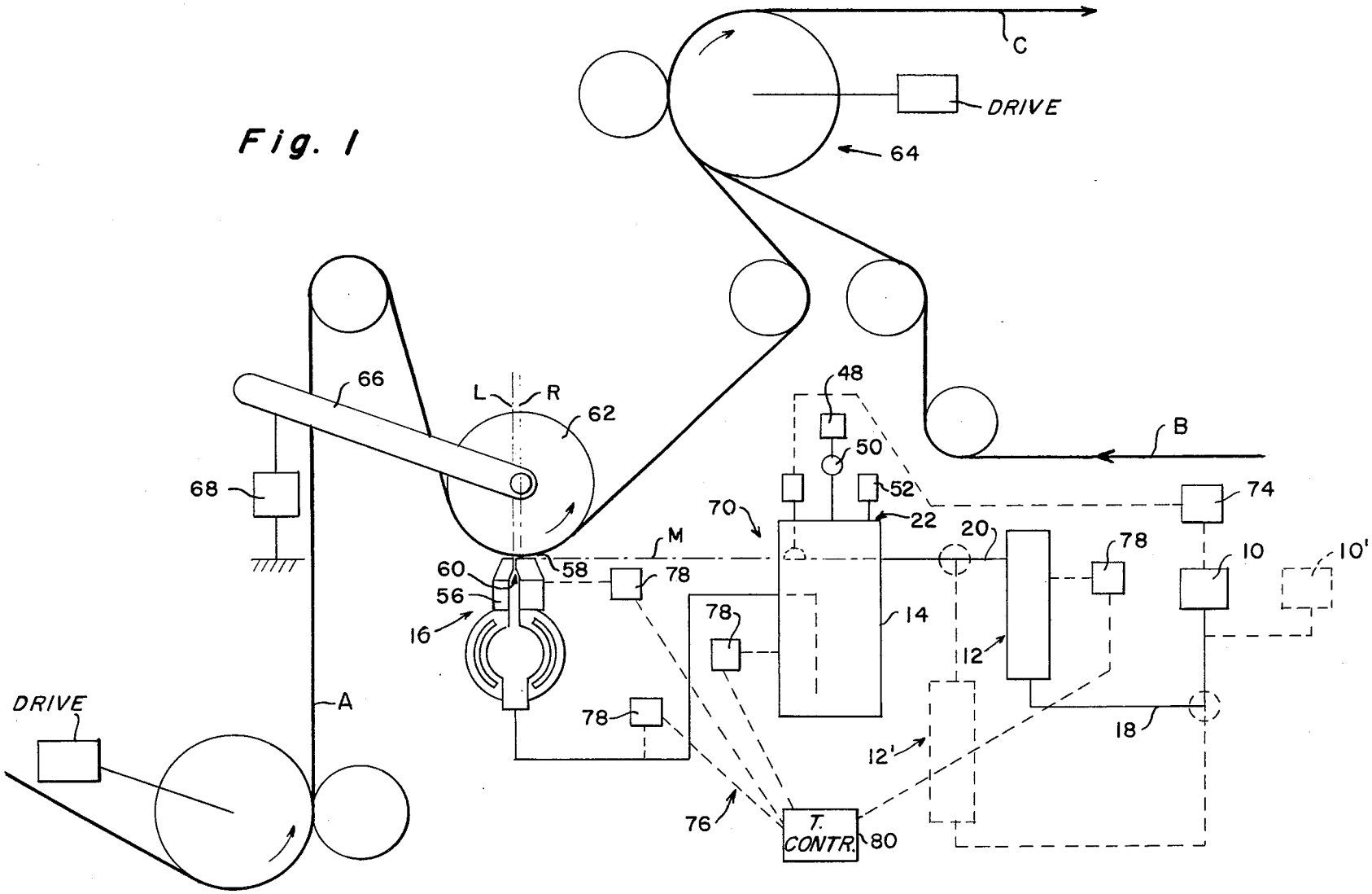
FIG. 1 is a schematic view of exemplary web-coating apparatus according to the present invention.
Figure 2:
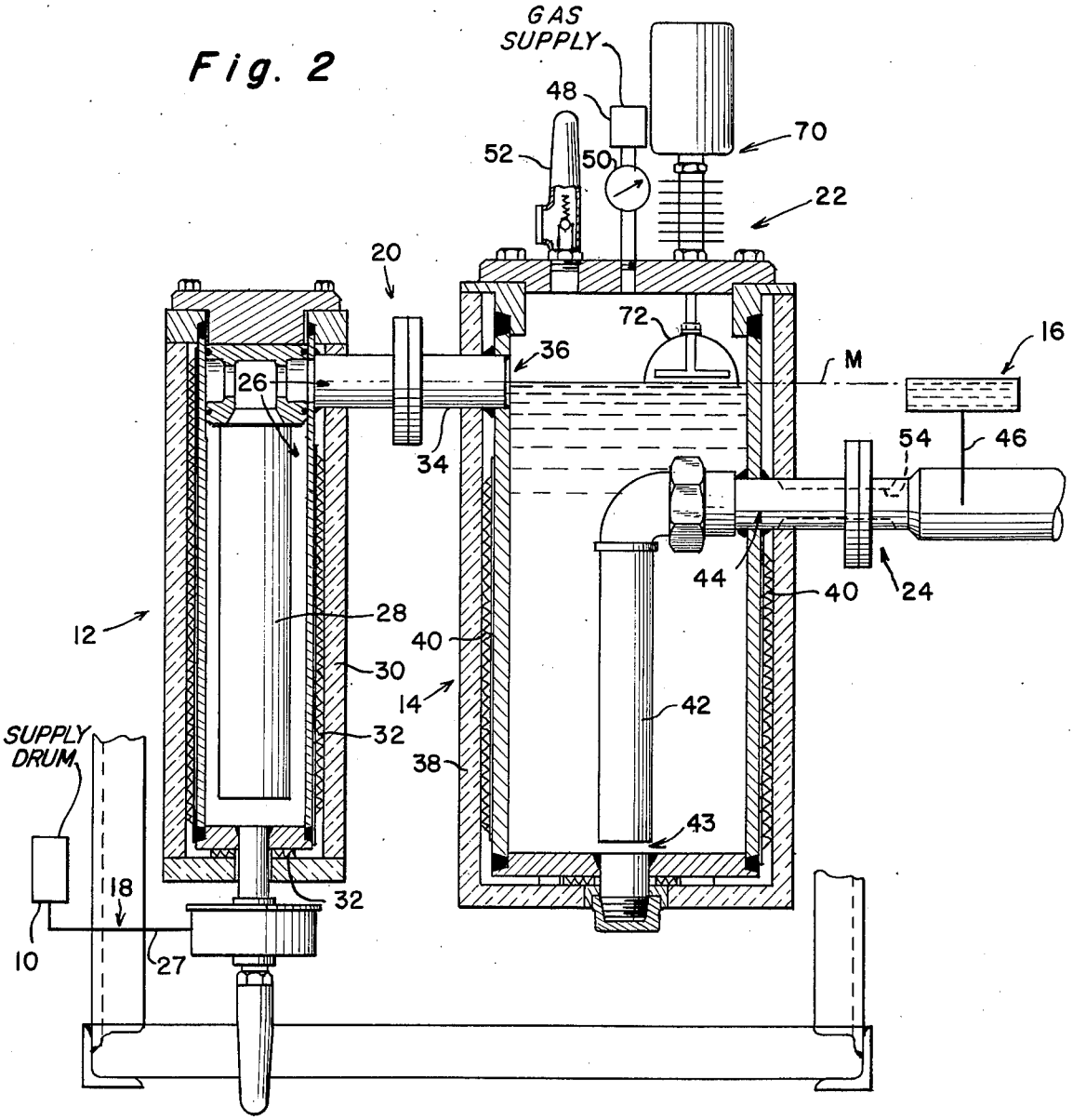
FIG. 2 is a detailed side view, partly in cross section and partly in elevation, of the filtering means and tank of the apparatus of FIG. 1.

Exemplary apparatus according to the present invention is shown schematically in FIG. 1 and in more detail in FIG. 2. The apparatus includes a source 10 of hot melt adhesive or like material to be coated on to a web A, filtering means 12, a tank 14, an extrusion head 16 for applying the hot melt or the like to the web A, first supplying means 18 for supplying the hot melt from the source 10 to the filtering means 12 and second supplying means 20 for supplying hot melt from the filtering means 12 to the tank 14, pumping means 22 for pumping the hot melt or the like from the tank to the extrusion head (the pumping means consists solely of means for providing gas at slightly more than one atmosphere pressure over the material in the tank 14), and means 24 for transporting the pumped liquid to the extrusion head 16 from the tank 14. Means 26 are also provided for insuring uniform temperature of the liquid material to be applied when the material is a hot melt or the like, without agitation of the liquid material.

The source 10 may comprise any conventional source of liquid material; when a hot melt is the material being applied it is desired that the source comprises a heated self-contained dispensing apparatus with built-in pump such as shown in U.S. Pat. No. 3,282,469, the disclosure of which is hereby incorporated by reference in the present specification. The first supplying means 18 comprises a pump 27 connected between the source 10 and the filtering means 12. If desired (as shown in dotted lines in FIG. 1) a second source 10' may be provided connected in parallel with the source 10 connected to the pipe 27. In this way, a continuous flow from a source 10, 10' could be provided were one of the drums associated with a source 10, 10' being changes.

The filtering means 12 includes a filter element 28 surrounded by an insulated cover 30, and preferably the filter is heated as by strip and ring heaters 32. An exemplary filter element 28 that could be employed is a Ronningen Petter tricluster filter element No. 7BCFT-400 mesh with 80 mesh backup for filter No. S-73-2218-ST. The filter 28 is so constructed that material is forced from the bottom of the filter housing up and through a narrow gap between the heated filter housing and the filter causing a turbulent flow and excellent heat transfer to the material when it is desired that the material be heated. The heaters 32 for heating the material passing through the filtering means 12 preferably comprise Chromalox strip heaters (i.e. SN-1825-240V) and Chromalox ring heaters (i.e. No. A-20-300W-240V).

The second supplying means 20 includes a conduit 34 leading from the filtering means 12 to the tank 14, an entry 36 for the conduit 34 being provided at an upper portion of the tank 14. The conduit 34 is designed so that when the hot melt flows into the tank 14, the material forms a thin film and therefore flows through a good heat transfer section. The positioning of the conduit 34 at 36, and the subsequent withdrawal of hot melt from the tank 14 adjacent the bottom thereof (as will be described more fully hereinafter) results in the deaeration of the hot melt without utilization of mechanical deaerators or other special structures. When the material flows into the tank 14, the large bubbles come to the surface and pop at 36, while the smaller bubbles form a foam on the top of the material. Any bubbles remaining at the bottom of the tank 14 from which the hot melt is withdrawn are so small that they burst at the forming lip of the coating head 16 and cause no holes in the coated film. Additionally, since a foam of small bubbles will normally cover the top of the material in the tank 14, the area above the material in the tank 14 may be filled with air instead of an inert gas, the foam preventing oxidation of the hot melt except in extreme operating conditions or especially sensitive hot melts. The expense of supplying an inert gas blanket may thus be avoided.

The tank 14 also is heated when hot melt or like heated material is to be used in the coating, the tank 14 having an insulated exterior 38 and having Chromalox heaters 40 associated therewith (i.e., Chromalox strip heater No. S-1837-240V) and Chromalox ring heater A-65-750W-240V). The means 24 for transferring liquid to the extrusion head 16 from the tank 14 includes a conduit 42 adjacent the bottom of the tank 14 and vertically extending upwardly therefrom, the conduit 42 exiting from the tank 14 at 44. A connecting portion 46 is provided between the conduit 42 and the extrusion head 16. The conduit 42 and connection conduit 46 preferably also are heated at the portions thereof exterior of the tank 14, as by electric resistance heating means, or by oil traced flex lines.

The pumping means 22 includes a source 48 of pressurized gas to provide the blanket and pumping means for the liquid. The gas may be air — as discussed above — or if desired an inert gas such as nitrogen may be provided. Even when an inert gas is used, the relative costs according to the invention are minimized since only a relatively small volume of gas need be provided. A pressure gauge 50 may be connected with the gas source 48 and the tank 14 to control the pressure of the gas at the top of the tank 14 above the liquid material, and a pressure relief valve 52 may be provided for venting of gas should the pressure become too great (increased pressure might adversely affect the application of coating material at the head 16). The gas at the top of the tank 14 need only be at a pressure slightly greater than a 1 atmosphere in order to provide for proper pumping of the liquid; an exemplary useful pressure is about 15 psi.

The means for insuring uniform temperature of hot melt without agitation includes the particular filter construction and construction of conduit 34 as discussed above. Additionally, in conduit 42 leading from the tank 14 to extrusion head 16 surface formations (shown diagrammatically in dotted lines at 54 in FIG. 2), such as ribs formed in a heated flexible hose, are provided for forcing the material into a turbulent flow over a heated surface. The material is also metered to a thin film flowing over the heated bottom of the tank at the inlet 43 for the conduit 42 (see FIG. 2), again developing good heat transfer into the material. Thus, it is apparent that the means 26 according to the present invention provide for turbulent flow and/or metering of material in a thin film over a heated surface, to adequately provide uniform heating (and thus viscosity) of the hot melt material without the degrading, shearing and whipping provided in the prior art pumps and agitators.

The coating head 16 may comprise any suitable coating heads such as shown in copending commonly assigned U.S. patent application Ser. No. 645,619 filed Dec. 31, 1975 (the disclosure of which is hereby incorporated by reference in the present application) and in commonly assigned U.S. application Ser. No. 775,582 filed Mar. 8, 1977 and entitled "BREAST ROLLER PIVOTING" (the disclosure of which is also incorporated by reference herein). The extrusion head 16 may comprise an extrusion head having an upper flat substantially horizontal surface 58 (which may be called the forming lip) having a narrow elongated opening 60 formed therein substantially the same length as the width of the extrusion head 16, the opening having a substantially vertical centerline L. A breast roller 62 of relatively hard material may be mounted over the head 16 for contacting a web A to be coated. The coated material may be applied directly onto the web A passing between the breast roller 62 and the head 16 as shown in FIG. 1, or alternatively — as shown in copending application Ser. No. 645,619 — the material may be directly applied to the breast roller and then subsequently applied to a transfer roller and then to the web A. When the web A is to be coated with hot melt adhesive, a face web B will also be provided, the web B being joined to the web B by pinch rollers 64 to make a combined web C (such as a pressure sensitive adhesive label). The web A may be the release paper and the web B the face paper, or vice versa. Other suitable web driving and coating arrangements are also possible.

The breast roller 62 has radii R, and the breast roller is so mounted with respect to the extrusion head 16 that no radius R of the breast roller 62 is coextensive with the extrusion head opening centerline L. A lever 66 (which is described more particularly in the above-mentioned copending application, Ser. No. 775,582) may be provided for mounting the breast roller 62, hydraulic means 68 or the like being provided for pivoting the lever 66 and thus adjusting the spacing of the roller 62 with respect to the forming lip 58 of the extrusion head 16.

In order to minimize start-up waste of hot melt at the extrusion head, and for otherwise providing an efficient system, it is desirable that the extrusion head never drains or overflows when the coating operation is temporarily interrupted. This is accomplished by providing means 70 for maintaining the liquid level in the tank 14 at a predetermined level M. The predetermined level M being maintained at the level of liquid in the extrusion head (i.e., even with forming lip 58) so that venting of the pressurized gas from the tank 14 the extrusion head 16 substantially will not drain or overflow. The means 70 may comprise a level detector 72, and control means 74 responsive to the sensing of the level by the level detector 72 for increasing the supply of material from the source 10 to the filtering means 12. The level detector may be of any conventional type (i.e., a Robert Shaw level switch number SL-1-0-4-E7-24).

Where heated liquid is to be applied, especially hot melt, means 76 are provided for stepping up the temperature from the source 10 to the tank 14, the temperature of material applied at the extrusion 16 being slightly less than the temperature of the material in the tank 14. The stepping up of the temperature allows the saving of energy, and reduces thermal degradation of the hot melt since the amount of material maintained at application temperature at any one time is relatively small. For instance, during running conditions as little as 1 gallon need be at application temperature for about 1 minute, and the tank 14 could be designed so that it was as small as 1 gallon. Normally, the tank 15 would be designed so that it contained about 9 gallons (unless a dual filtering arrangement where provided), however even in such a case because separate temperature means are associated with the filtering means 12, holding tank 14, flex line 42 to the head 16, and the head 16 itself, the maximum amount of material that would ever be at temperature would be about 15 gallons. The tank 14 is sized so that a whole roll of web A may be run while the drums in source 10 are being changed, however, if a dual filtering arrangement is provided (shown at dotted lines at 12' in FIG. 1) and/or the dual source system (10, 10') are provided, the size of the tank can be greatly reduced, even to a 1-gallon volume. Individual temperature sensing means 78 are provided for the head 16 conduit 42, tank 14 and filtering means 12, all of such individual temperature sensing means 78 being connected up to master temperature control 80 (FIG. 1). In a preferred embodiment of the invention where hot melt material is to be coated onto a web, the means 80 could maintain the temperature of material in the filter at 250° F., in the tank at 315° F., and in the head 16 and conduit 42 at 300° F.

Exemplary apparatus according to the invention having been described, the method according to the present invention will now be particularly set forth.

According to a method of the present invention, a method is provided for coating a web A with hot melt material, the method comprising the steps of feeding hot melt from a source 10 to a tank 14, supplying hot melt from the tank 14 to an extrusion head 16, passing a web A to be coated in operative relationship with the extrusion head 16 to coat the web A with hot melt, and pumping the hot melt from the tank to the extrusion head solely by providing pressurized gas at slightly more than one atmosphere pressure over the hot melt in the tank 14 (by pumping means 22). The pressurized gas may be air at about 15 psi, or inert gas could be used. The method comprises the further steps of feeding the hot melt from the source through a filter to the tank, and isolating the source pressure from the supply pressure at the extrusion head, such isolation of the source pressure from the supply pressure at the extrusion head insuring that a pressure drop across the filter (as when the filter becomes clogged) does not influence the pressure to the process and thereby affect the coating operation. The method also comprises the step of metering the hot melt to a thin film flowing over heated surfaces and feeding the hot melt from the source to the tank and effecting turbulent flow from the tank to the head and thereby insuring thermal uniformity of the hot melt without agitation. The hot melt is also maintained at a predetermined level in the tank, and the extrusion head is provided at substantially the same predetermined level so that the extrusion head need never be drained and start-up waste of hot melt is substantially reduced. The hot melt is fed into the tank and withdrawn from the tank so that bubbles in the hot melt come to the surface in the tank and pop and/or form a foam on the top of the hot melt so that the withdrawn hot melt is substantially air free. As little as one gallon of hot melt may be maintained at application temperature at any one time. The filter, tank, extrusion head and conduit between the tank and extrusion head are heated, and the temperatures of each of the filter, tank, head, and conduit are controlled so that the temperature of hot melt is stepped up from the source 10 to the tank 14, the temperature of hot melt applied at the extrusion head 16 being slightly less than the temperature of hot melt in the tank 14. Exemplary temperatures are 250° F. at the filter, 315° F. at the tank, and 300° F. for the tank 16 and conduit 42.

It will thus be seen that according to the present invention, a simplified improved method and apparatus for the application of liquid material to an article have been provided, especially an improved method and apparatus for the coating of a web with hot melt. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for supplying liquid material to coat a web, comprising a closed system including a source of heated liquid material, filtering means, a tank, an extrusion head having a substantially horizontal forming lip and a substantially vertical elongated supply opening, means for supplying liquid material from said source to said filtering means, means for supplying liquid material from said filtering means to said tank and for isolating the material pressure at said source from the pressure at said extrusion head, means for heating said liquid material in said filtering means, tank, and extrusion head, means for pumping said liquid material from said tank to said extrusion head, said pumping means consisting of means for providing gas at slightly more than one atmosphere pressure over the material in said tank, and means for transporting said pumped liquid from said tank to said extrusion head substantially vertical elongated supply opening, said means including an elongated conduit.

2. Apparatus as recited in claim 1 wherein said heating means comprises means for insuring uniform material temperature without agitation.

3. Apparatus as recited in claim 2 wherein said means for insuring uniform material temperature without agitation comprises formation means in said filtering means and said means for supplying heated liquid material from said filtering means to said tank for forcing said material through narrow gaps to meter the material to a thin film flowing over heated surfaces.

4. Apparatus as recited in claim 3 wherein said means for insuring uniform material temperature without agitation further comprises formation means in said means for transporting pumped liquid to said extrusion head for providing turbulent flow over a heated surface.

5. Apparatus as recited in claim 1 wherein said means for supplying liquid material from said filtering means to said tank and for isolating the material pressure at said source from the pressure at said extrusion head includes a conduit connected to a top portion of said tank, and wherein said means for transporting said pumped liquid to said extrusion head from said tank comprises a conduit having an opening adjacent the bottom of said tank and leading upwardly therefrom.

6. Apparatus as recited in claim 1 further comprising means for maintaining the liquid material in said tank at a predetermined level, said predetermined level being maintained at the level of liquid in said extrusion head so that upon venting of pressurized gas from said tank said extrusion head will not drain or overflow.

7. Apparatus as recited in claim 6 wherein said means for maintaining the liquid material in said tank at a predetermined level comprises a level detector, and means responsive to said level detector for increasing the supply of material from said source to said filtering means.

8. Apparatus as recited in claim 1 wherein said pumping means comprises means for supplying gas at a predetermined pressure to said tank over said material and for maintaining said gas at a predetermined pressure, said supplying and maintaining means comprising a pressure-relief valve.

9. Apparatus as recited in claim 1 wherein said source of heated liquid material comprises a self-contained pumping and heating barrel unit.

10. Apparatus as recited in claim 1 wherein said filtering means, means for supplying liquid from said source to said filtering means, means for supplying material from said filtering means to said tank, and means for transporting pumped liquid from said tank to said extrusion head all are heated, and further comprising means for controlling the temperature of liquid in each of said means so that the temperature is stepped up from said source to said tank, the temperature of material applied at said extrusion head being slightly less than the temperature of material in said tank.

11. Apparatus as recited in claim 1 wherein said extrusion head comprises an upper flat substantially horizontal surface having a narrow elongated opening formed therein of substantially the same length as the width of said extrusion head, said opening having a substantially vertical centerline, said apparatus further comprising a breast roller of hard material for contacting a web to be coated, said breast roller rotatable about a generally horizontal axis and positioned above said extrusion head opening for cooperation therewith, said breast roller being so mounted with respect to said extrusion head that no radius of said breast roller is coextensive with said extrusion head opening centerline.

12. Apparatus as recited in claim 1 wherein the volume of said tank is about one gallon.

13. Apparatus for supplying heated liquid material for application to an article, comprising an extrusion head for application of material to an article, said head having a substantially horizontal forming lip and a substantially vertical elongated supply opening, a tank operatively connected to the extrusion head, a source connected to said tank, means for keeping liquid in said tank and extrusion head heated, means for pumping liquid material from the tank to the extrusion head elongated supply opening, said pumping means consisting of means for providing gas at slightly more than one atmosphere pressure over the material in the tank, and means for maintaining the liquid material in said tank at a predetermined level, said predetermined level being maintained at the level of liquid in said extrusion head so that upon venting of pressurized gas from said tank said extrusion head will not drain or overflow, said level maintaining means comprising a level detector means for controlling the feed of liquid material from said source to said tank.

14. Apparatus for supplying liquid material to coat a web, comprising a closed system including a source of liquid material, filtering means, a tank, an extrusion head, means for supplying liquid material from said source to said filtering means, means for supplying liquid material from said filtering means to said tank and for isolating the material pressure at said source from the pressure at said extrusion head, said means including a conduit connected to a top portion of said tank, means for pumping said liquid from said tank to said extrusion head, said pumping means consisting of means for providing gas at slightly more than one atmosphere pressure over the material in said tank, and means for transporting said pumped liquid from said tank to said extrusion head, said means comprising a conduit having an opening adjacent the bottom of said tank and leading upwardly therefrom.

* * * * *